United States Patent [19]

Leary et al.

[11] 4,196,596

[45] Apr. 8, 1980

[54] LIQUID TRAP FOR FREEZE-UP PROTECTION ON AIR COOLED CENTRIFUGAL CHILLER

[75] Inventors: John W. Leary, Onalaska; Mark O. Bergman; John L. Honeck, Sr., both of La Crosse, all of Wis.

[73] Assignee: The Trane Company, La Crosse, Wis.

[21] Appl. No.: 972,310

[22] Filed: Dec. 22, 1978

[51] Int. Cl.[2] ..... F25B 1/00

[52] U.S. Cl. ..... 62/498; 62/219; 137/247.41

[58] Field of Search ..... 62/218, 219, 115, 498; 137/247.41, 247.11

[56] References Cited

U.S. PATENT DOCUMENTS

| | | | |
|---|---|---|---|
| 1,805,901 | 5/1931 | Bergdoll | 62/219 |
| 1,819,861 | 8/1931 | Bergdoll | 62/219 |
| 3,260,067 | 7/1966 | McClure et al. | 62/505 |
| 3,299,653 | 1/1967 | Osborne | 62/115 |
| 3,857,253 | 12/1974 | Burgett et al. | 62/289 |
| 4,081,971 | 4/1978 | Eber | 62/216 |

*Primary Examiner*—Ronald C. Capossela
*Attorney, Agent, or Firm*—Carl M. Lewis; Peter D. Ferguson

[57] ABSTRACT

An air cooled centrifugal liquid chiller is disclosed which includes an air cooled condenser exposed to ambient conditions such that, during those times when the temperature of the ambient is at a relatively low level and the chiller is inoperative, refrigerant will tend to migrate to and condense in the air cooled condenser. If this accumulated condensed refrigerant is permitted to then flow by gravity to the evaporator of the chiller, the heat exchange liquid within the tubes thereof may freeze, causing possible damage. In order to prevent this occurrence, the conduit means connecting the air cooled condenser to the evaporator are provided with a trap portion disposed at a level above the maximum level of condensed refrigerant accumulation within the air cooled condenser, which trap portion is vented to a point in the air cooled condenser above said maximum level. In this manner, during those times when the chiller is inoperative, accumulated condensed refrigerant in the air cooled condenser is prevented from passing to the evaporator. In the preferred embodiment, the conduit means connecting the air cooled condenser to the evaporator include a generally inverted U-shaped portion having a bight portion disposed above the maximum level of refrigerant accumulation in order to define the aforesaid trap.

4 Claims, 1 Drawing Figure

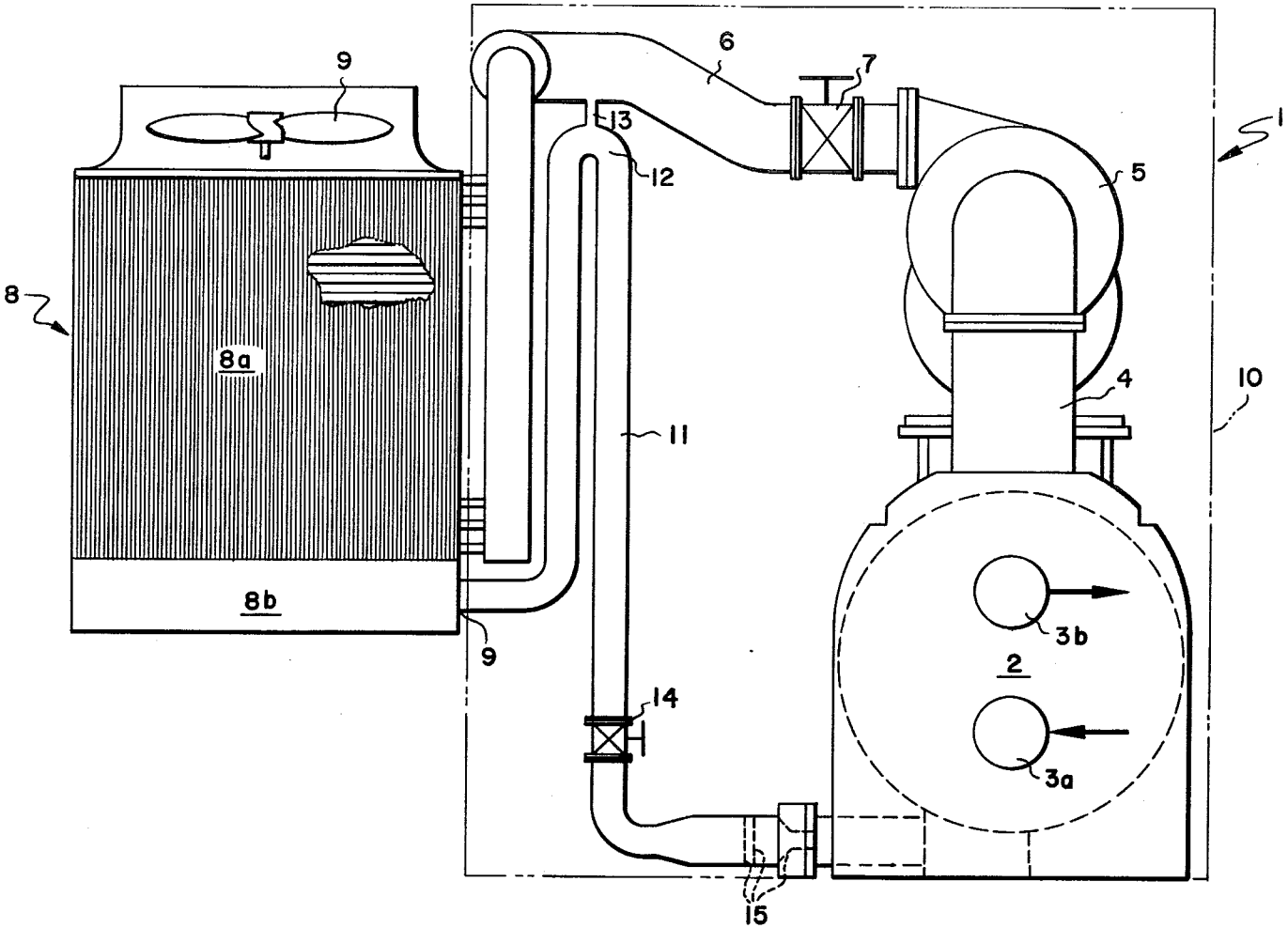
1
10
5
4
3b
3a
2
7
6
12
13
11
14
15
9
9
8a
8b
8

LIQUID TRAP FOR FREEZE-UP PROTECTION ON AIR COOLED CENTRIFUGAL CHILLER

TECHNICAL FIELD

The present invention relates to a refrigeration system of the type designed to produce relatively large quantities of chilled liquid for use in applications such as building air conditioning. In particular, the system of the present invention comprises an air cooled centrifugal liquid chiller, including a centrifugal compressor for compressing refrigerant and an air cooled condenser for condensing the compressed refrigerant.

BACKGROUND ART

Air cooled centrifugal liquid chillers are known in the art, as exemplified by U.S. Pat. No. 3,857,253. Moreover, the problem associated with chillers of this type when exposed to low ambient conditions during machine shut down have been recognized and a solution thereto proposed in U.S. Pat. No. 4,081,971. In this patent, a relatively complex valve is provided in the conduit means which connect the air cooled condenser to the evaporator, which valve is automatically closed during those times when the chiller is inoperative so as to prevent refrigerant flow to the evaporator. The present invention represents an improvement over this patent through the provision of a trap disposed within the conduit means connecting the air cooled condenser and evaporator in order to prevent refrigerant flow therebetween during those times when the chiller is inoperative. The present invention has been found to present a cost savings while also affording increased reliability of operation over that scheme disclosed in the aforementioned patent.

DISCLOSURE OF THE INVENTION

The air cooled centrifugal liquid chiller of the present invention includes evaporator means for vaporizing a condensed refrigerant by heat exchange with a source of liquid, whereby a chilled liquid is produced, and centrifugal compressor means connected to the evaporator means for receiving vaporized refrigerant and compressing same. Connected to the centrifugal compressor means by first conduit means are air cooled condenser means which receive and condense the compressed refrigerant by heat exchange with a source of air. The air cooled condenser means is exposed to the source of air such that, during those times when the chiller is inoperative and the temperature of the air is at a relatively low level, condensed refrigerant may accumulate within the condenser means to a predetermined maximum level, at least a portion of the evaporator means being disposed at a level below said maximum.

Second conduit means are provided for passing condensed refrigerant from the air cooled condenser means to the evaporator means, including expansion means for reducing the pressure of refrigerant prior to its passage into the evaporator means, which second conduit means further comprise a trap portion disposed at a level above said maximum. Vent conduit means provide communication, at least during those times when the chiller is inoperative, between the trap portion of the second conduit means and a point in the air cooled condenser means above said maximum level, whereby condensed refrigerant which accumulates within the air cooled condenser means during those times when the chiller is inoperative is prevented from passing to the evaporator means and causing possible freeze-up therein.

In the preferred embodiment, the second conduit means include a generally inverted U-shaped portion having a bight portion disposed above the maximum level to which condensed refrigerant may accumulate within the air cooled condenser means, thereby defining said trap portion. Preferably, the vent conduit means comprise an unobstructed conduit of relatively small diameter providing communication at all times between the trap portion and the first conduit means.

Accordingly, it is a primary object of the present invention to provide an air cooled centrifugal liquid chiller wherein an inexpensive, simple, and reliable scheme is provided for preventing the flow of condensed refrigerant from the air cooled condenser to the evaporator during those times that the chiller is inoperative and the air cooled condenser means is exposed to relatively low temperature air.

A more specific object of the invention is the utilization of a trap in the conduit means connecting the air cooled condenser and evaporator in order to prevent refrigerant flow therebetween, as aforesaid.

These and other objects of the present invention will become apparent hereinafter wherein the best mode for carrying out the invention is disclosed with reference to the appended drawing.

BRIEF DESCRIPTION OF DRAWING

The FIGURE illustrates in schematic form the air cooled centrifugal liquid chiller comprising the present invention.

Best Mode For Carrying Out The Invention

Turning then to the FIGURE, the air cooled centrifugal liquid chiller of the present invention, indicated generally by reference numeral 1, shown to include evaporator means 1 which are of the conventional shell-and-tube type wherein a shell is provided for containing a quantity of liquid refrigerant through which a plurality of heat exchange tubes pass for carrying a source of liquid in heat exchange with the refrigerant, whereby the refrigerant is vaporized and the liquid chilled. For the sake of clarity, inlet manifold **3*a* and an oulet manifold 3*b* are indicated diagrammatically to indicate the flow of liquid into and out of evaporator means 2**.

Refrigerant which is vaporized in evaporator 2 passes via a conduit 4 to centrifugal compressor means 5. Preferably, centrifugal compressor means 5 comprise a centrifugal compressor of the type which is driven by an electric motor through a set of gears whereby the rotational speed of the impeller of the compressor is increased. Compressors of this type are known in the art and, in the present system, the preferred refrigerant would be R-12.

Compressed refrigerant from centrifugal compressor means 5 passes via first conduit means 6, which includes a normally open service valve 7, to air cooled condenser means indicated generally by reference numeral 8. As shown, condenser means 8 comprises a plurality of finned tubes within which the refrigerant condenses and over which air is forced in heat exchange relationship by suitable fan means 9. Preferably, the air cooled condenser means includes a first portion indicated generally by reference numeral **8*a* wherein refrigerant condenses, and a second portion 8*b* comprising a subcooler section wherein the temperature of the condensed refrigerant is further reduced. As shown, the subcooler includes a condensed refrigerant outlet indicated at 9**.

It will be appreciated that air cooled condenser means 8 is located so as to be exposed to a source of ambient air, while the remaining components of the system are housed within a suitable weatherproof housing indicated generally by reference numeral 10. Reference may be had to the aforementioned U.S. Pat. No. 4,857,253 for further details of such enclosure.

During those times when air cooled condenser means 8 is exposed to relatively low ambient temperatures and the chiller itself is inoperative, refrigerant will tend to migrate thereto and condense within its tubes, thereby increasing the level of condensed refrigerant contained therein. As is apparent from the FIGURE, evaporator means 2 is disposed at a level substantially below that of the air cooled condenser means 8 whereby, unless appropriate precautions are taken, condensed refrigerant which accumulates within the air cooled condenser means would flow by gravity to the evaporator means 2. This is an undesirable condition during those times when the chiller is inoperative due to the fact that this refrigerant will be at a relatively low temperature such as could cause freezing of the heat exchange liquid contained within the tubes of evaporator means 2.

In order to prevent this problem, the second conduit means 11 which connect the outlet 9 of air cooled condenser means 8 to evaporator means 2 include a trap portion 12 which, as shown, is disposed at a level above the maximum level to which condensed refrigerant may accumulate within air cooled condenser means 8.

The maximum level to which refrigerant may accumulate within air cooled condenser means 8 will generally be the highest row of finned tubes included within the condenser means although such level may be determined by the quantity of refrigerant contained within the system. Refrigerant will generally not condense within first conduit means 6 which is disposed within weatherproofed enclosure 10 and at least a portion of which is disposed at a level.

Since trap portion 12 of second conduit means 11 is disposed above this maximum level, the condensed refrigerant will simply accumulate within the air cooled condenser means to the maximum level without flowing to evaporator means 2. It will be noted that trap portion 12 is suitably vented via vent conduit means 13 to a point in the air cooled condenser means above said maximum level. In the preferred embodiment, vent conduit means 13 comprises an unobstructed conduit of relatively small internal diameter providing communication at all times between the trap portion and the air cooled condenser means, although it would be within the scope of the invention to provide a solenoid-operated valve or a pressure differential responsive check valve within vent conduit means 13 in order to block communication therethrough during those times that the chiller is operative. The illustrated embodiment is preferred, however, due to the inherent reliability and low cost provided thereby.

It should be specifically noted that vent conduit means 13 is required in order to break the liquid seal at chiller shut down which is formed during operation within trap portion 12, thereby preventing siphon flow therethrough.

Second conduit means 11 also include a normally open service valve 14 and expansion means 15 for reducing the pressure of condensed refrigerant prior to its passage into evaporator means 2. In the preferred embodiment, expansion means 15 comprise a plurality of orifice plates and an expansion nozzle as disclosed fully in U.S. Pat. No. 3,260,067.

During those times when chiller 1 is operative, compressed refrigerant will pass from centrifugal compressor means 5, via first conduit means 6 to air cooled condenser means 8 wherein it will be condensed, passing therefrom via outlet 9, second conduit means 11 (including trap portion 12), and through expansion means 15 to evaporator means 2. During operation, only a slight amount of compressed, vaporized refrigerant will pass through vent conduit means 13 into trap portion 12 wherein it will be condensed by direct contact with subcooled liquid refrigerant contained thereon. Although this represents a theoretical loss in efficiency within the system, its magnitude is so small as to be negligible; this being due to the fact that vent conduit means 13 comprise a conduit having an inside diameter on the order of $\frac{1}{8}$ to $\frac{1}{4}$ inch. Moreover, the inherent simplicity of this scheme over those discussed above including some sort of valve means is of greater import.

During those times immediately following chiller shut down and air cooled condenser means 8 exposed to relatively low air temperatures, vaporized refrigerant from evaporator means 2 will migrate via conduit 4 and centrifugal compressor means 5 (it being appreciated that centrifugal compressors provide an open flow path therethrough when inoperative), and via second conduit means 6 to air cooled condenser means 8. This refrigerant will then condense due to the low temperatures encountered and accumulate within the condenser means. As pointed out previously, the maximum level to which condensed refrigerant may accumulate within air cooled condenser means 8 is determined generally by the uppermost row of finned tubes in the condenser. So long as trap portion 12 of second conduit means 11 is disposed above this maximum level, condensed refrigerant will be prevented from flowing to evaporator means 2 where it could cause possible freezeup.

Although in the preferred embodiment second conduit means 11 comprise a generally inverted U-shaped portion having a bight portion which defines trap portion 12, other configurations may be arrived at also including a trap portion disposed at the appropriate level which would also fall within the scope of the invention.

While theinvention has been described with respect to a preferred embodiment, it is to be understood that modifications thereto will be apparent to those skilled in the art within the scope of the invention, as defined in the claims which follow.

We claim:

1. An air cooled centrifugal liquid chiller comprising a. evaporator means for vaporizing a condensed refrigerant by heat exchange with a source of liquid, whereby a chilled liquid is produced;

b. centrifugal compressor means connected to said evaporator means for receiving vaporized refrigerant and compressing same;

c. air cooled condenser means connected to said centrifugal compressor means by first conduit means for receiving compressed refrigerant and condensing same by heat exchange with a source of air, said air cooled condenser means being exposed to said source of air such that, during those times when said chiller is inoperative and the temperature of said air is at a relatively low level, condensed refrigerant may accumulate within said condenser means to a predetermined maximum level, at least a portion of said evaporator means being disposed at a level below said maximum level;

d. second conduit means for passing condensed refrigerant from said air cooled condenser means to said evaporator means, including expansion means for reducing the pressure of said refrigerant prior to its passage into said evaporator means, said second conduit means further comprising a trap portion disposed at a level above said maximum level; and e. vent conduit means for providing communication, at least during those times when said chiller is inoperative, between the trap portion of said second conduit means and a point in said air cooled condenser means above said maximum level, whereby condensed refrigerant which accumulates within said air cooled condenser means during those times when said chiller is inoperative is prevented from passing to said evaporator means and causing possible freeze-up therein.

2. The air cooled centrifugal liquid chiller of claim 1 wherein said second conduit means includes a generally inverted U-shaped portion having a bight portion disposed above said maximum level to thereby define said trap portion.

3. The air cooled centrifugal liquid chiller of claim 1 wherein said vent conduit means comprise an unobstructed conduit of relatively small diameter providing communication at all times between said trap portion and said point in said air cooled condenser means.

4. The air cooled centrifugal liquid chiller of claims 1, 2, or 3 wherein said vent conduit means extend between said trap portion and said first conduit means.

* * * * *